US005293736A

United States Patent [19]

Stahlecker et al.

[11] Patent Number: 5,293,736

[45] Date of Patent: Mar. 15, 1994

[54] SPINNING MACHINE

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 850,310

[22] Filed: Mar. 12, 1992

[30] Foreign Application Priority Data

Mar. 20, 1991 [DE] Fed. Rep. of Germany ..... 4109023

[51] Int. Cl.[5] ..... D01H 13/04

[52] U.S. Cl. ..... 57/90

[58] Field of Search ..... 57/90, 315; 226/181, 226/182, 190

[56] References Cited

U.S. PATENT DOCUMENTS

| | | | |
|---|---|---|---|
| 1,893,809 | 1/1933 | Stone et al. | 57/315 |
| 2,736,162 | 2/1956 | Steinberger | 57/90 X |
| 3,043,083 | 7/1962 | Noguera | 57/315 |
| 3,312,050 | 4/1967 | Noguera | 57/315 X |
| 3,469,385 | 9/1969 | Tsuzuki | 57/90 X |
| 3,727,391 | 4/1973 | Hiserman et al. | 57/315 |
| 3,816,991 | 6/1974 | Takeuchi et al. | 57/90 |
| 4,355,749 | 10/1982 | Wülfing et al. | 226/190 X |

FOREIGN PATENT DOCUMENTS

| | | | |
|---|---|---|---|
| 817572 | 10/1951 | Fed. Rep. of Germany . | |
| 1179840 | 10/1964 | Fed. Rep. of Germany | 57/90 |
| 2335740 | 11/1974 | Fed. Rep. of Germany . | |

*Primary Examiner*—Joseph J. Hail, III

*Attorney, Agent, or Firm*—Evenson, McKeown, Edwards & Lenahan

[57] ABSTRACT

In the case of a spinning machine for the spinning of yarns from slivers which are fed in cans, the slivers are guided from the cans to the spinning stations by guiding devices which comprise several clamping devices arranged behind one another which transport the respective sliver. In some preferred embodiments, the clamping devices are constructed as drivable roller pairs. In other preferred embodiments, the clamping devices are clamping jaws carried on movable belts.

18 Claims, 3 Drawing Sheets

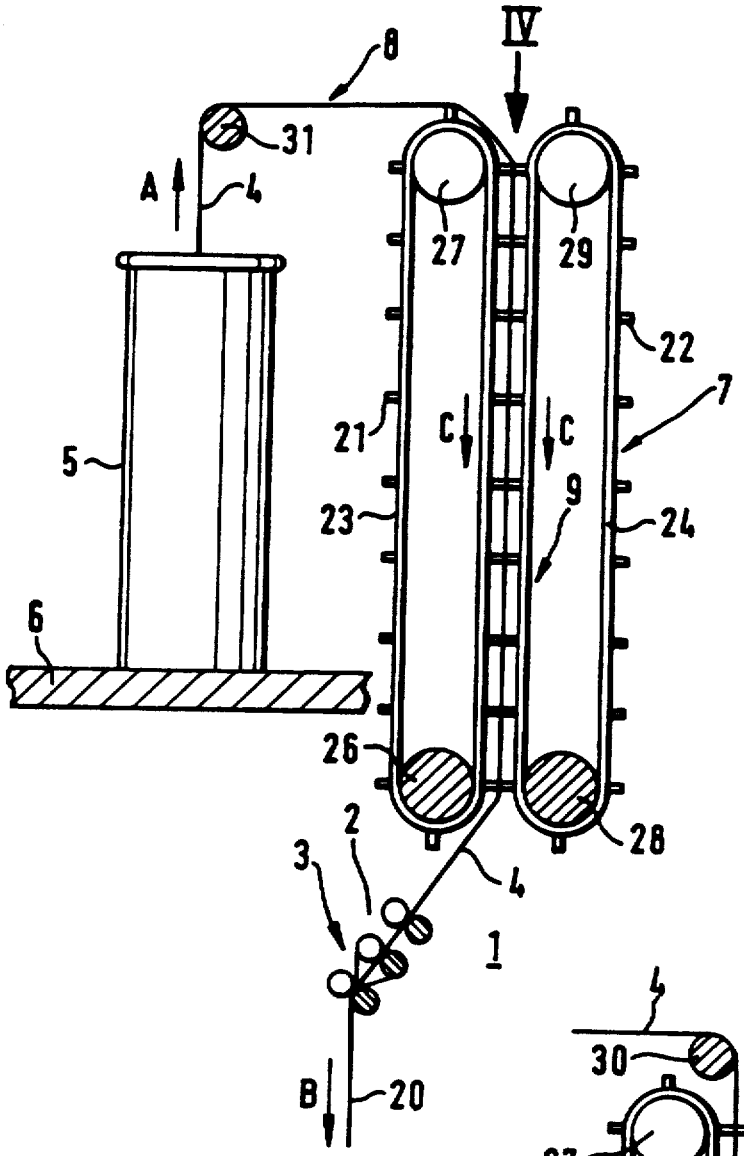
FIG. 3
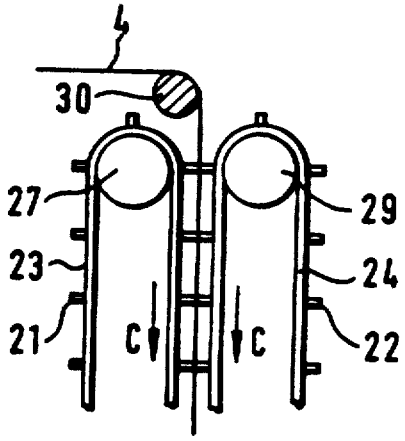
FIG. 5
FIG. 4
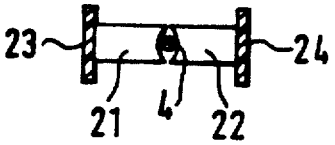

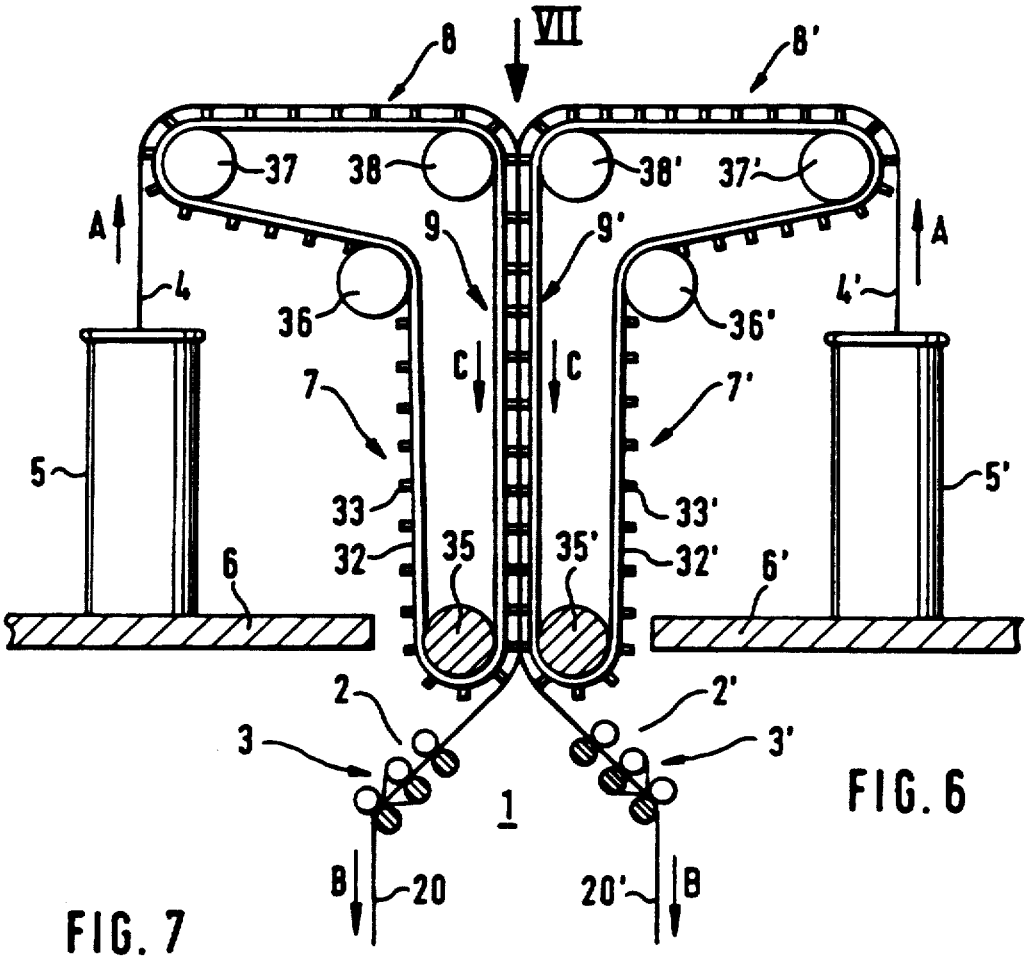
FIG. 6
FIG. 7
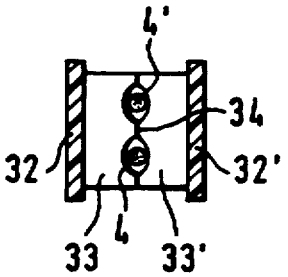
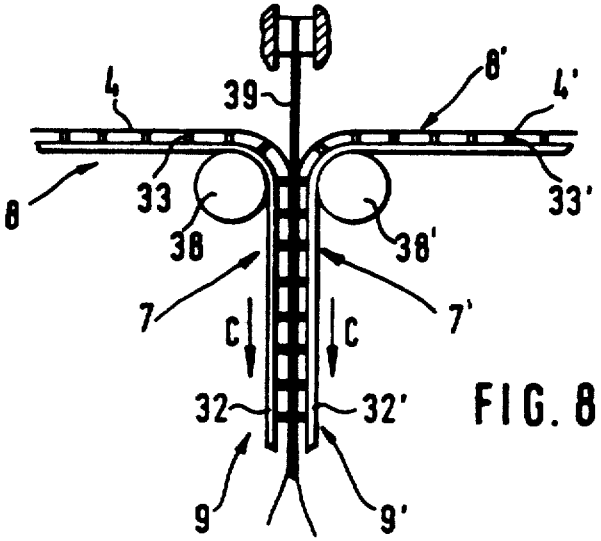
FIG. 8

SPINNING MACHINE

BACKGROUND AND SUMMARY OF THE INVENTION

This invention relates to a spinning machine having several spinning stations for the spinning of yarns from slivers which are fed to the spinning stations in cans, guiding devices for the slivers being provided between the cans and the spinning stations.

The feeding of the fiber material to be spun in the form of slivers disposed in cans is known, for example, in the case of open-end spinning machines. In the case of the machines which are available on the market, the slivers are withdrawn directly by the sliver feeding device of the individual spinning stations from the cans disposed in front of and partly below the spinning arrangement.

It is also known (German Patent Document DE-C 23 35 740), in the case of open-end spinning machines, to arrange the cans on a platform above the spinning machine and feed the slivers through guiding tubes to the spinning stations. These guiding tubes, which are provided with baffles, are to serve as an intermediate storage device which, on the basis of a special construction, is fed by a continuously running feeding device nevertheless intermittently. Then the sliver is to be guided through the respective guiding tube essentially without tensile stress.

The feeding of the fiber material in the form of slivers made available in cans is also known in the case of other fast-running spinning machines, such as wind-around spinning machines or air spinning machines. As a rule, these are one-sided machines, in the case of which the slivers withdrawn from the cans deposited on the rear side of the spinning machine are fed to the spinning stations from above. In this case, guiding devices for the slivers are provided in the form of pulleys and guide rods.

It is also known (German Patent Document DE-PS 817 572) to feed slivers in cans in the case of ring spinning machines, in which case the cans are deposited on platforms or in a space above the spinning machine. In this case, relatively long travelling paths are obtained with one or several vertical sections which lead to the risk that the slivers may hang out; that is, are drafted uncontrollably as a result of their own weight. Such an arrangement is therefore possible only for slivers which have a relatively coarse size and thus a relatively high strength.

However, the spinning of slivers of coarse sizes is very difficult on ring spinning machines. Since the ring spinning machines have only a relatively low delivery speed at the outlet of the drafting units, the feeding rollers of the drafting units—while the required drafting is taken into account—must run very slowly; that is, at rotational speeds of one revolution per minute and less. It is technically extremely difficult to let long shafts, like the feeding rollers of drafting units, run at such low rotational speeds with sufficient precision. There is the risk that these shafts will rotate only jerkily so that no controlled draft is obtained. The feeding of the fiber material to be spun in cans has therefore not been carried out successfully in practice in the case of ring spinning machines.

In an older German Patent Application (P 40 41 112.5, PA 1170, P 9342), which is no prior publication, it is suggested to provide guiding devices which comprise drivable guide pulleys which are arranged to be offset with respect to one another in a vertical section so that the slivers are guided in a slalom-type manner from pulley to pulley. In the same older patent application, a further variant is suggested in which the slivers are guided on their path to the drafting units between two guiding aprons disposed against one another.

It is an object of the invention to develop a spinning machine of the initially mentioned type in such a manner that fine slivers may also be fed in cans without the risk of faulty drafts, particularly in vertical sections of the transport path.

This object is achieved according to preferred embodiments of the invention in that the guiding devices comprise several clamping devices which are arranged behind one another and transport the respective sliver.

In the case of the development according to the invention, it is achieved that the slivers are supported and are nevertheless moved in the transport direction. As a result, it is possible to feed also relatively thin slivers in cans; that is, slivers of sizes of approximately Nm 0.4 to 0.8. In this case, these fine slivers may also be transported in the vertical direction along larger sections. It is therefore possible to carry out a can feeding also in the case of ring spinning machines because, on the basis of the slivers with the fine sizes, while taking into account the draft, the feeding roller pairs of the drafting units still run at a sufficiently high speed so that a uniform round rotating is ensured. By means of this can feeding, it will then be possible, in the case of ring spinning machines, to do without a premounted machine, specifically the flyer. In the case of other spinning machines, which are equipped with drafting units into which the slivers travel, it is possible to feed finer slivers so that then the drafting units may be simplified. For example, in the case of machines of this type, there is the possibility to use, instead of five-cylinder drafting units, the three-cylinder drafting units which are customary today in the case of ring spinning machines.

Also in the case of open-end machines, the feeding of finer slivers results in advantages because then the opening-up work for the separating of the fibers is reduced so that, during the opening-up, the fibers are processed more carefully. It is therefore possible to spin finer yarns with less damaged fibers so that the yarns have a higher quality.

In an advantageous development of the invention, the clamping devices are formed by drivable roller pairs. By means of this arrangement, longer paths with many curves can also be bridged, in which case the expenditures are relatively low.

In another development of the invention, the clamping devices may be formed by clamping jaws which are arranged on guiding belts, of which two are assigned to one sliver. In this case, the clamping devices are held so that they are movable in the transport direction of the sliver so that an existing clamping is maintained along the whole transport path.

In the case of the addressed clamping, the sliver must only be pressed slightly; that is, the clamping devices must contact one another only slightly or possibly not at all. The slight clamping can be achieved in that the clamping devices are slightly recessed in the area of the sliver.

Other objects, advantages and novel features of the present invention will become apparent from the following detailed description of the invention when considered in conjunction with the accompanying drawings.

BRIEF DESCRIPTION OF THE DRAWINGS

FIG. 3 is a partial cross-sectional view similar to FIG. 1, showing a different embodiment of the invention, in which guiding belts are provided which comprise two clamping jaws;

FIG. 4 is a partial view of FIG. 3 in the direction of the arrow IV of FIG. 3;

FIG. 5 is a partial view from FIG. 3 in its upper area with a different guidance of the sliver;

FIG. 6 is a partial view similar to FIG. 3 with another embodiment of the guiding belts;

FIG. 7 is a partial view from FIG. 6 in the direction of the arrow VII of FIG. 6; and FIG. 8 is a partial view from FIG. 6 in its upper area with another embodiment of the invention.

DETAILED DESCRIPTION OF THE DRAWINGS

Figure 1:
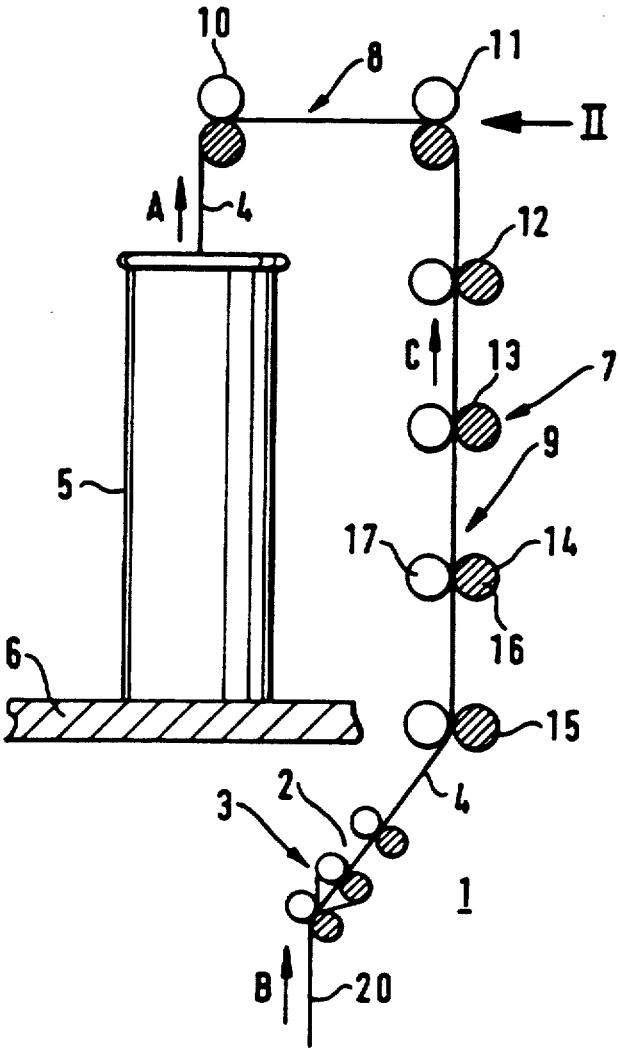
FIG. 1 is a partial cross-sectional view of a spinning machine constructed according to a preferred embodiment of the invention, in which case only the drafting unit of one side of the machine is shown to which a sliver is fed from a can deposited on a platform, the sliver being transported by roller pairs.

In FIG. 1, only a drafting unit 2 of an individual spinning station 3 is shown of a spinning machine 1. However, such a spinning machine 1 comprises a plurality of such spinning stations 3 which are arranged in a row next to one another on one side of the machine or on both sides of the machine. A twist-providing machine, such as a ring spindle or a wind-around spindle or an air nozzle , which is not shown, connects to each drafting unit 2. Likewise, a sliver feeding device of an open-end spinning machine may be arranged at the point of the drafting unit 2. At each of these spinning stations 3, a sliver 4 is withdrawn from a can 5 and spun into a yarn.

In the embodiment according to FIG. 1, the cans 5 of the individual spinning stations 3 are disposed above the spinning machine 1 on a platform 6. The cans 5, which normally have an outside diameter which is larger than the spacing of the spinning stations 3 (spacing of the spinning stations in the longitudinal direction of the machine), are deposited in several rows extending in the longitudinal direction of the spinning machine 1.

The slivers 4 are withdrawn in the direction of the arrow A upward from the cans 5, which are open on top, and are then transported downward to the drafting units 2. In order to securely bridge this path also in the case of fine sizes of the slivers 4 without the occurrence of faulty drafts in the fine slivers 4, special guiding devices 7 are provided.

The guiding devices 7 extend along a horizontal section 8 as well as along a vertical section 9, in which case this information must be qualified such that both sections 8 and 9 may also have a certain slope with respect to the horizontal or vertical direction.

Figure 2:
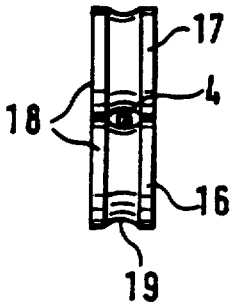
FIG. 2 is an enlarged view of a detail of FIG. 1 in the direction of the arrow II of FIG. 1.

Between the can 5 and the drafting unit 2, a plurality of roller pairs are provided for each sliver 4, in the present case, the roller pairs 10, 11, 12, 13, 14 and 15. These roller pairs 10 to 15 form the guiding device 7. Each roller pair 10 to 15 comprises a drivable roller 16, which preferably extends through in the longitudinal direction of the machine, as well as a pressure roller which is assigned to it. According to FIG. 2, the rollers 16 and 17 rest against one another only by means of lateral ring collars 18 and, in the area in which the sliver 4 is guided, have a recess 19 so that the clamping onto the sliver 4 is relatively low.

The roller pairs 10 and 11 bound the horizontal section 8. In this case, roller pair 10 is disposed approximately centrically above the can 5. Roller pair 11 can be counted to be part of the horizontal section 8 as well as of the vertical section 9 which is bounded by roller pair 15. Starting here, the sliver 4 is guided into the drafting unit 2 from where the drafted yarn 20 is guided in the direction of the arrow B to a twist providing device which is not shown.

In the construction according to FIG. 1, the sliver 4, during its transport in the direction of the arrow C, is conveyed from one clamping device to the next, for example, from roller pair 12 to roller pair 13. The respective section of the sliver is therefore periodically clamped and released again from a clamping device.

The construction according to FIG. 3 differs from the above-described construction essentially because of the fact that the clamping point of the sliver 4 continuously travels along with the sliver 4 in the transport direction C.

In the construction according to FIG. 3, the clamping devices are formed by clamping jaws 21 and 22, in which case clamping jaws 21 are arranged on a circulating guiding belt 23, and clamping jaws 22 are arranged on a circulating guiding belt 24. As demonstrated by the enlarged view according to FIG. 4, the clamping jaws 21 and 22 do not completely touch. In addition, they have a concave construction in the direction of the sliver 4 so that the sliver 4 is clamped only slightly.

The guiding belts 23 and 24 are arranged such that they bridge the vertical section 9, in which case they exercise onto the sliver 4 the slight clamping explained by means of FIG. 4. In the area of the drafting unit 2, the guiding belt 23 has a driving pulley 26, while it has a deflection pulley 27 at the deflecting point between the horizontal section 8 and the vertical section 9. Correspondingly, the guiding belt 24 is guided by means of a driving pulley 28 as well as a deflection pulley 29.

The guiding belts 23 and 24 are constructed as flat belts to which the clamping jaws 21 and 22 are fastened which are constructed as injection molded parts.

While, in the construction according to FIG. 3, the deflection pulley 27 of the guiding belt 23 bounds the horizontal section 8, a separate deflection pulley 30 for the sliver 4 exists also in the case of the construction according to FIG. 5 above the deflection pulleys 27 and 29 so that the sliver 4 is introduced precisely vertically between the clamping jaws 21 and 22. In the construction according to FIG. 3 as well as in the construction according to FIG. 5, another deflection pulley 31, which may possibly also be drivable, exists above the can 5.

In the embodiment according to FIG. 6, the spinning machine—and this may also apply to the previously described embodiments—is equipped with two machine sides in which case, in the representation according to FIG. 6, the right machine side is supplemented by a ' added to the reference numbers. Reference number 3 therefore indicates a spinning station on the left machine side; reference number 3' indicates a spinning station on the right side of the machine.

In the construction according to FIG. 6, guiding belts 32 and 32' were used which extend along the horizontal section 8 and 8' as well as along the vertical section 9 and 9'. The guiding belts 32 and 32', which again have clamping jaws 33 and 33', are constructed such that they have a total of two recesses at their joint 34 (FIG. 7), specifically one for the sliver 4 of the left side of the machine and one for the sliver 4' on the right side of the machine. The guiding belts 32 and 32' are therefore simultaneously assigned to two slivers 4 and 4' which are guided next to one another on the clamping jaws 33, 33' (see FIG. 7).

In the area of the drafting units 2, 2', the guiding belts 32, 32' each again have a driving pulley 35 and 35'. Above the cans 5 and 5', the guiding belts 32, 32' are guided by means of a total of 3 deflection pulleys 36 and 36', 37 and 37' as well as 38 and 38'. In this case, the deflection pulleys 37, 37' are situated approximately centrically above the cans 5, 5'. The deflection pulleys 38, 38' represent the transition between the respective horizontal section 8, 8' to the vertical section 9, 9'. On their circumferential surface, the deflection pulleys 36, 36' are provided with recesses so that the clamping jaws 33, 33' may run by way of the deflection pulleys 36, 36'.

According to the variant of FIG. 8, it may be provided that a sliding band 39 is situated in the vertical section 9, 9' between the two guiding belts 32, 32' and is clamped in above the deflection pulleys 38, 38'. The respective clamping jaws 33, 33', in this case, press the pertaining sliver 4, 4' against the common sliding band 39 so that here also clamping devices exist which are arranged behind one another.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine comprising:

a plurality of spinning stations for spinning yarn from sliver, and transport devices for transporting sliver to the spinning stations from sliver supply cans without drafting the sliver during the transport thereof;

wherein the transport devices define a sliver transport path between the sliver cans and the spinning stations, which transport path includes a first section starting above the sliver cans and a second essentially vertical section, and wherein the transport devices, include a plurality of clamping devices arranged behind one another in the second section, each of said plurality of clamping devices in the second section being driven to carry out transport of the sliver while clamping same.

2. A spinning machine according to claim 1, wherein the clamping devices are held to be movable in the transport direction of the sliver.

3. A spinning machine according to claim 2, wherein the clamping devices are formed by clamping jaws which are arranged on a guiding belt, of which two clamping jaws are assigned to one sliver.

4. A spinning machine according to claim 3, wherein the clamping jaws are constructed to be convex in the direction of the sliver.

5. A spinning machine according to claim 4, wherein the clamping jaws which are assigned to one another are separated from one another by means of a sliding band.

6. A spinning machine according to claim 5, wherein the guiding belts form the vertical section serving for the clamping of the silver as well as the first section, which first section is an essentially horizontal section which leaves the silver unclamped.

7. A spinning machine according to claim 3, wherein the guiding belts form the vertical section serving for the clamping of the silver as well as the first section, which first section is an essentially horizontal section which leaves the silver unclamped.

8. A spinning machine according to claim 7, wherein the clamping jaws in the horizontal section are used as a support for the sliver.

9. A spinning machine according to claim 2, wherein clamping jaws which are assigned to one another are separated from one another by means of a sliding band.

10. A spinning machine according to claim 1, wherein said plurality of clamping devices in the second section are drivable roller pairs.

11. A spinning machine according to claim 10, wherein two groups of roller pairs are provided, of which one group is assigned to the first section which is configured as an essentially horizontal section and the other group is assigned to the second section.

12. A spinning machine according to claim 11, wherein one of the roller pairs is part of both groups.

13. A spinning machine according to claim 11, wherein one of the roller pairs is arranged approximately centrically above a pertaining sliver supply can.

14. A spinning machine according to claim 1, wherein said plurality of clamping devices in the second section are formed by clamping jaws carried by respective endless transport belts facing one another along the second section of the sliver travel path.

15. A spinning machine according to claim 14, further comprising a sliding band interposed between the clamping jaws along the second section of the sliver travel path.

16. A spinning machine according to claim 1, wherein the transport devices are configured as first and second endless belts, a first section of the first belt extending from above a first sliver supply can disposed at one side of the machine, a first section of the second belt extending from above a second sliver supply can disposed at an opposite side of the machine from the first supply can, said first and second belts together facing one another to clamp and transport the slivers from both the first and second supply cans.

17. A spinning machine according to claim 16, wherein each of the first and second belts include sliver clamping jaws which face corresponding sliver clamping jaws of the respective facing belt along said second section of the travel path of the slivers.

18. A spinning machine according to claim 17, further comprising a sliding band interposed between the belts along said second section of the travel path of the slivers, said sliding band serving as a back-up support surface for respective ones of said slivers disposed at respective opposite sides of said sliding band.

* * * * *